US009938926B2

(12) United States Patent
Yamazaki et al.

(10) Patent No.: US 9,938,926 B2
(45) Date of Patent: Apr. 10, 2018

(54) AIR LEADING-TYPE STRATIFIED SCAVENGING TWO-STROKE INTERNAL-COMBUSTION ENGINE

(71) Applicant: Yamabiko Corporation, Tokyo (JP)

(72) Inventors: Takahiro Yamazaki, Tokyo (JP); Takamasa Otsuji, Tokyo (JP); Hidekazu Tsunoda, Tokyo (JP)

(73) Assignee: Yamabiko Corporation, Tokyo (JP)

( * ) Notice: Subject to any disclaimer, the term of this patent is extended or adjusted under 35 U.S.C. 154(b) by 75 days.

(21) Appl. No.: 14/873,273

(22) Filed: Oct. 2, 2015

(65) Prior Publication Data

US 2016/0097343 A1 Apr. 7, 2016

(30) Foreign Application Priority Data

Oct. 7, 2014 (JP) ..... 2014-206749
Oct. 7, 2014 (JP) ..... 2014-206750

(51) Int. Cl.

| | |
|---|---|
| ***F02F 3/24*** | (2006.01) |
| ***F02B 25/14*** | (2006.01) |
| ***F02B 75/02*** | (2006.01) |
| ***F02B 75/16*** | (2006.01) |
| ***F02B 25/02*** | (2006.01) |
| *F02F 1/22* | (2006.01) |
| *F02F 7/00* | (2006.01) |

(52) U.S. Cl.

CPC ..... *F02F 3/24* (2013.01); *F02B 25/02* (2013.01); *F02B 25/14* (2013.01); *F02B 75/02* (2013.01); *F02B 75/16* (2013.01); *F02B 2075/025* (2013.01); *F02F 1/22* (2013.01); *F02F 7/0004* (2013.01)

(58) Field of Classification Search

CPC ..... F02B 2075/025; F02B 25/14; F02B 1/04; F02B 25/20; F02F 1/22; F02F 3/24; F02F 1/186; F02M 69/10

USPC ..... 123/65 P

See application file for complete search history.

(56) References Cited

U.S. PATENT DOCUMENTS 5,588,504 A * 12/1996 Spiegel ..... F01M 1/08 123/195 R
6,571,756 B1 * 6/2003 Rosskamp ..... F02B 25/22 123/73 A (Continued)

FOREIGN PATENT DOCUMENTS

WO 0181739 A1 11/2001

OTHER PUBLICATIONS

Extended European Search Report issued in corresponding European Patent Application No. 15188709.8 dated Mar. 16, 2016 (7 pages).

*Primary Examiner* — Long T Tran
(74) *Attorney, Agent, or Firm* — Kilyk & Bowersox, P.L.L.C.

(57) ABSTRACT

The certainty of supplying air to a scavenging channel through a piston groove is improved. In a cylinder wall 2, a gas venting port 10 is formed below and adjacent to a scavenging port 6*a*. The gas venting port 10 is independent from the scavenging port 6*a*, and is opened/closed by a piston as each of an air port 4*a* and the scavenging port 6*a* is. Upon a piston groove 8 being brought into communication with the gas venting port 10 as a result of the piston moving up (FIG. 1(II)), blown-back gas in a piston groove 8 can move to a crankcase through the gas venting port 10. Along with this, air can enter the piston groove 8 from the air port 4*a*.

8 Claims, 10 Drawing Sheets

(56) References Cited

U.S. PATENT DOCUMENTS

| | | | | |
|---|---|---|---|---|
| 6,718,917 | B2 * | 4/2004 | Andersson | F02B 25/14 123/73 A |
| 6,758,170 | B1 * | 7/2004 | Walden | F02B 25/02 123/21 |
| 6,857,402 | B2 | 2/2005 | Schlossarczyk et al. | |
| 7,536,982 | B2 * | 5/2009 | Yuasa | F01M 3/02 123/73 A |
| 8,181,622 | B2 * | 5/2012 | Tsuchida | F01M 1/08 123/193.4 |
| 8,726,859 | B2 * | 5/2014 | Yuasa | F02B 25/06 123/195 R |
| 8,770,159 | B2 * | 7/2014 | Takayanagi | F02B 25/16 123/65 V |
| 8,881,696 | B2 * | 11/2014 | Kunert | F02B 25/14 123/76 |
| 2004/0045517 | A1 | 3/2004 | Fleig et al. | |
| 2005/0139179 | A1 | 6/2005 | Mavinahally et al. | |
| 2005/0155563 | A1 | 7/2005 | Yuasa et al. | |
| 2010/0059030 | A1 * | 3/2010 | Ishida | F02B 25/14 123/73 R |
| 2011/0048366 | A1 * | 3/2011 | Tsuchida | F01M 1/08 123/193.6 |
| 2011/0146642 | A1 * | 6/2011 | Geyer | B22C 9/10 123/73 PP |
| 2014/0182571 | A1 * | 7/2014 | Takayanagi | F02B 43/02 123/73 PP |
| 2016/0097344 | A1 | 4/2016 | Yamazaki et al. | |

* cited by examiner

AIR LEADING-TYPE STRATIFIED SCAVENGING TWO-STROKE INTERNAL-COMBUSTION ENGINE

BACKGROUND OF THE INVENTION

The present application claims priority from Japanese Patent Application No. 2014-206749, filed Oct. 7, 2014, and Japanese Patent Application No. 2014-206750, filed Oct. 7, 2014, which are incorporated herein by reference.

The present invention generally relates to a two-stroke internal-combustion engine and more specifically relates to an air leading-type engine that first induces air to flow into a combustion chamber in a scavenging stroke.

Two-stroke internal-combustion engines are often used in portable work machines such as brush cutters and chain saws. This type of two-stroke internal-combustion engine includes a scavenging channel that brings a crankcase and a combustion chamber into communication with each other. Air-fuel mixture pre-compressed in the crankcase is induced to flow into the combustion chamber through the scavenging channel, and scavenging is performed by the air-fuel mixture.

As well-known, two-stroke engines of the type in which scavenging is performed using air-fuel mixture have the problem of "air-fuel mixture (new gas) blow-by". In response to this problem, air leading-type stratified scavenging two-stroke internal-combustion engines have been proposed and already put into practical use. See U.S. Pat. No. 6,857,402, for example. Prior to scavenging, the air leading-type stratified scavenging engine charges air to a scavenging channel. In a scavenging stroke, first, the air in the scavenging channel is discharged to the combustion chamber, and then the air-fuel mixture in the crankcase is induced to flow into the combustion chamber through the scavenging channel.

FIG. 14 is a diagram illustrating a conventional air leading-type stratified scavenging engine. In FIG. 14, in order to avoid confusion of drawn lines, illustration of a piston is omitted. In the figure, reference numeral 100 denotes a cylinder wall. In the cylinder wall 100, an air channel 102 and an air-fuel mixture channel (not shown) open. An air port is indicated by reference numeral 102*a*. Also, in the cylinder wall 100, a scavenging port 104*a* of a scavenging channel 104 opens. The scavenging channel 104 communicates with a crankcase. Each of the air port 102*a* and the scavenging port 104*a* is opened/closed by the piston. The piston has a groove 106 in a peripheral surface thereof. The piston groove 106 extends in a circumferential direction.

(I) to (III) of FIG. 14 indicate states in the course of a piston moving up: (II) of FIG. 14 indicates a state in which the piston moves up relative to the position in (I) of FIG. 14. (III) of FIG. 14 indicates a state in which the piston moves up relative to the position in (II) of FIG. 14.

Referring to (I) of FIG. 14, in the piston groove 106, a gas blown back in previous scavenging process is mixed. The blown-back gas contains air-fuel mixture components. The blown-back gas remaining in the piston groove 106 is indicated by dots. Along with upward movement of the piston from the bottom dead center, a pressure in the crankcase becomes negative. (II) of FIG. 14 illustrates a state in which the piston groove 106 communicates with the air port 102*a*. In the state in (II) of FIG. 14, the piston groove 106 is not in communication with the scavenging port 104*a*. Therefore, even though the piston groove 106 communicates with the air port 102*a*, no air flows from the air port 102*a* into the piston groove 106. In other words, the blown-back gas in the piston groove 106 does not flow.

(III) in FIG. 14 indicates a state in which the piston groove 106 communicates the air port 102*a* and also communicates with the scavenging port 104*a*. As a result of the piston groove 106 coming into communication with the scavenging port 104*a*, air can be supplied from the air port 102*a* to the scavenging channel 104 via the piston groove 106.

With reference to (III) in FIG. 14, in theory, in a conventional air leading-type stratified scavenging two-stroke internal-combustion engine, a flow of gas in the piston groove 106 occurs only when the piston groove 106 communicates with the scavenging port 104*a*. Then, the gas in the piston groove 106 first enters the scavenging channel 104, and then air enters from the air port 102*a* to the scavenging channel 104 through the piston groove 106. Therefore, a timing of the air entering the scavenging channel 104 from the piston groove 106 is later than a timing of the piston groove 106 starting communicating with the scavenging channel 104.

As well-known, for air leading-type two-stroke internal-combustion engines for work machines, piston valve-type ones are employed. In other words, an air port 102*a*, a scavenging port 104*a*, and an exhaust port and the like are opened/closed by a piston. In a piston valve-type engine, a gas flow is controlled by a pressure balance between two spaces or channels that communicate with each other or are isolated from each other via a piston.

A two-stroke engine for a work machine is run at a high rotation rate of, for example, 10,000 rpm. Therefore, the aforementioned timing delay largely affects the efficiency of air charge into a scavenging channel 104. In other words, conventional stratified scavenging two-stroke engines have the essential problem of difficulty in ensuring the certainty of charging air into the scavenging channel 104 in each cycle.

In a scavenging stroke, an air leading-type stratified scavenging engine first discharges burned gas by means of air and then charges air-fuel mixture into a combustion chamber. In theory, employment of the air leading-type stratified scavenging method should enable substantial improvement in emission characteristics. However, in reality, the emission characteristics improvement effect is limited by the aforementioned essential problem.

In order to respond to the aforementioned timing delay, substantially advancing a timing for the piston groove 106 to communicate with the scavenging port 104*a* has been proposed. However, employment of this configuration results in the air-fuel mixture components remaining in the scavenging channel 104 easily flowing to the air channel 102 side, which causes decrease in emission characteristic improvement effect.

An object of the present invention is to provide an air leading-type stratified scavenging two-stroke internal-combustion engine that can improve the certainty of supplying air to a scavenging channel through a piston groove.

Another object of the present invention is to provide an air leading-type stratified scavenging two-stroke internal-combustion engine that can improve the certainty of an amount of air to be supplied to a scavenging channel through a piston groove.

A still another object of the present invention is to provide an air leading-type stratified scavenging two-stroke internal-combustion engine that can improve the certainty of an air supply timing for supplying air to a scavenging channel through a piston groove.

SUMMARY OF THE INVENTION

The aforementioned objects are achieved by the present invention providing an air leading-type stratified scavenging two-stroke internal-combustion engine including:

an air port that opens in a cylinder wall and is opened/closed by a piston;

a scavenging channel including a scavenging port that opens in the cylinder wall and is opened/closed by the piston, the scavenging channel communicating with a crankcase;

a piston groove formed in a peripheral surface of the piston, the piston groove enabling the air port and the scavenging port to communicate with each other; and a gas venting port that opens in the cylinder wall independently from the scavenging channel and is opened/closed by the piston, wherein the gas venting port is positioned on the crankcase side that is lower than the scavenging port in a cylinder axis direction, and wherein in a course of the piston moving up, before the piston groove that is in communication with the air port comes into communication with the scavenging port, the piston groove that is in communication with the air port comes into communication with the gas venting port.

FIG. 1 is a diagram for describing an idea of the present invention. With reference to FIG. 1, reference numeral 2 denotes a cylinder wall, which corresponds to the cylinder wall 100 illustrated in FIG. 14. Reference numeral 4 in FIG. 1 denotes an air channel and reference numeral 4*a* denotes an air port, the air channel 4 and the air port 4*a* corresponding to the air channel 102 and the air port 102*a* illustrated in FIG. 14. Reference numeral 6 in FIG. 1 denotes a scavenging channel, and reference numeral 6*a* denotes a scavenging port, the scavenging channel 6 and the scavenging port 6*a* corresponding to the scavenging channel 104 and the scavenging port 104*a* illustrated in FIG. 14. Reference numeral 8 in FIG. 1 denotes a piston groove, which corresponds to the piston groove 106 illustrated in FIG. 14.

Also with reference to FIG. 1, in the cylinder wall 2, a gas venting port 10 is formed below the scavenging port 6*a* in a cylinder axis direction and adjacent to the scavenging port 6*a*. The gas venting port 10 is set so as not to, when a piston is positioned at the bottom dead center, open to a combustion chamber. In other words, the piston positioned at the bottom dead center is set to close the gas venting port 10. A position where the gas venting port 10 is disposed is preferably a position that is lower than an upper edge of a piston ring of the piston when positioned at the bottom dead center. The gas venting port 10 is independent from the scavenging port 6*a*, and as the air port 4*a* and the scavenging port 6*a* are, the gas venting port 10 is opened/closed by the piston. The gas venting port 10 communicates with a crankcase via the scavenging channel 6.

(I) to (III) in FIG. 1 illustrates states in the course of the piston moving up toward the top dead center. (II) of FIG. 1 illustrates a state in which the piston moves up relative to the position in (I) of FIG. 1 and the piston groove 8 that is in communication with the air port 4*a* are thereby brought into communication with the gas venting port 10. (III) in FIG. 1 illustrates a state in which the piston moves up relative to the position in (II) of FIG. 1 in the cylinder axis direction and the piston groove 8 is thereby brought into communication with the scavenging port 6*a*.

In the course of the piston moving up from the bottom dead center, a pressure in the crankcase becomes negative. In the course of the piston moving up, blown-back gas in the piston groove 8 does not flow until the piston groove 8 comes into communication with the air port 4*a* ((I) in FIG. 1). Upon the piston further moving up and the piston groove 8 coming into communication with the gas venting port 10 ((II) in FIG. 1), the piston groove 8 being thereby brought into communication with the crankcase via the gas venting port 10. Consequently, the blown-back gas in the piston groove 8 can move to the crankcase via the gas venting port 10. Along with the flow of the blown-back gas in the piston groove 8 toward the crankcase, air from the air port 4*a* can enter the piston groove 8.

In other words, upon the piston groove 8 coming into communication with the gas venting port 10, inside the piston groove 8, a gas flow from the air port 4*a* toward the crankcase via the gas venting port 10 is generated.

Upon the piston further moving up and the piston groove 8 being thereby brought into communication with the scavenging port 6*a*, the gas flow already generated in the piston groove 8 continues so as to be provided to the scavenging port 6*a* ((III) of FIG. 1). Therefore, simultaneously with the piston groove 8 coming into communication with the scavenging port 6*a*, air can enter the scavenging port 6*a* through the piston groove 8.

In other words, according to the present invention, prior to the piston groove 8 coming into communication with the scavenging port 6*a* as a result of the piston groove 8 being brought into communication with the crankcase having a negative pressure through the gas venting port 10, a gas flow in the piston groove 8 is generated. Consequently, simultaneously with the piston groove 8 coming into communication with the scavenging port 6*a*, initial motion of air flow for charging air to the scavenging port 6*a* through the piston groove 8 can be enhanced. Then, the enhancement of the initial motion enables enhancement of the certainty of charging air to the scavenging channel 6 in each cycle.

The piston groove 8 included in the present invention may have a height dimension that in the course of the piston moving up in the cylinder axis direction, allows the piston groove 8 that is communication in the air port 4*a* to come into communication with the scavenging port 6*a* and the gas venting port 10 simultaneously (FIG. 2). Also, the piston groove 8 included in the present invention may have a height dimension that when the piston is positioned at the top dead center and in communication with the scavenging port 6*a*, allows interruption of the communication between the air port 4*a* and the gas venting port 10 (FIG. 3). The piston groove 8 having such height dimension first comes into communication with the gas venting port 10 and then comes into communication with the air port 4*a* in the course of the piston moving up.

FIG. 4 illustrates an alteration of the engine illustrated in FIG. 1. The engine illustrated in FIG. 4 is the same as the engine in FIG. 1 in including a gas venting port 10 formed in a cylinder wall 2. The engine illustrated in FIG. 4 includes a pressure transmission through hole 12 formed in a piston groove 8. The pressure transmission through hole 12 consistently communicates with a crankcase.

(I) to (IV) of FIG. 4 illustrate states in the course of a piston moving up toward the top dead center. (II) of FIG. 4 illustrates a state in which the piston moves up relative to the position in (I) of FIG. 4 and immediately before the piston groove 8 is thereby brought into communication with an air port 4*a*. (III) of FIG. 4 illustrates a state in which the piston moves up relative to the position in (II) of FIG. 4 and the piston groove 8 that is in communication with the air port 4*a* is thereby brought into communication with the gas venting port 10. (IV) of FIG. 4 illustrates a state in which the piston moves up relative to the position (III) of FIG. 4 and the piston groove 8 is thereby brought into communication with a scavenging port 6*a*.

In the course of the piston moving up from the bottom dead center, a pressure in the crankcase becomes negative. In the course of the piston moving up, the negative pressure in the crankcase affects the piston groove 8 through the pressure transmission through hole 12. Consequently, the pressure in the piston groove 8 starts decreasing and along with the pressure decrease, blown-back gas in the piston groove 8 starts flowing ((II) of FIG. 4).

Upon the piston moving up and the piston groove 8 being thereby brought into communication with the gas venting port 10 ((III) of FIG. 4), the blown-back gas in the piston groove 8 can move to the crankcase through the gas venting port 10. Along with the gas in the piston groove 8 flowing toward the crankcase, air from the air port 4*a* can enter the piston groove 8.

Upon the piston further moving up and the piston groove 8 being thereby brought into communication with the scavenging port 6*a*, the gas flow already generated in the piston groove 8 continues so as to be provided to the scavenging port 6*a* ((IV) of FIG. 4). Therefore, simultaneously with the piston groove 8 coming into communication with the scavenging port 6*a*, air can enter the scavenging port 6*a* through the piston groove 8.

According to the present invention, a gas flow can be started in the piston groove 8 before the piston groove 8 comes into communication with the scavenging channel 6. Consequently, simultaneously with the piston groove 8 coming into communication with the scavenging channel 6, the gas can be made to flow to the scavenging channel 6 through the piston groove 8. Therefore, the certainty of charging air to the scavenging channel 6 through the piston groove 8 can be enhanced.

Other objects of the present invention and operation and effects of the present invention will be clarified from the following detailed description of a preferable embodiment of the present invention.

DETAILED DESCRIPTION OF THE PRESENT INVENTION

A preferable embodiment of the present invention will be described below with reference to the attached drawings.

Figure 5:
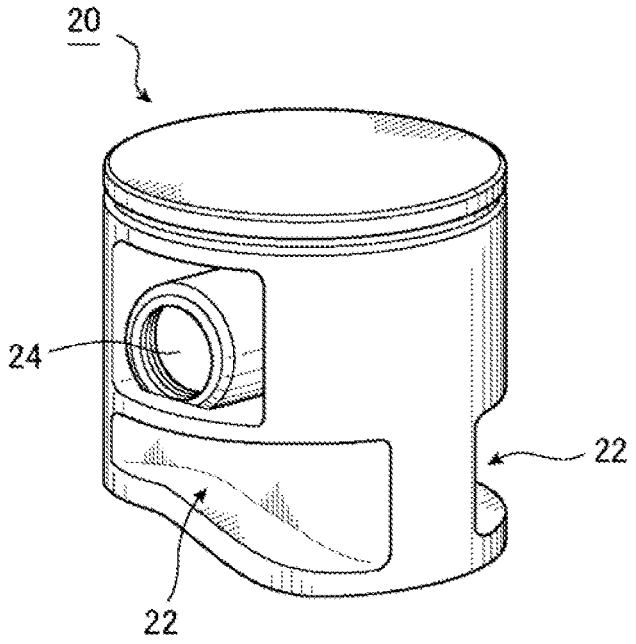
FIG. 5 is a perspective view of a piston included in an air leading-type stratified scavenging two-stroke internal-combustion engine according to an embodiment of the present invention.

FIG. 5 illustrates a piston included in an air leading-type stratified scavenging two-stroke internal-combustion engine according to an embodiment of the present invention. With reference to FIG. 5, a piston 20 includes piston grooves 22 in a peripheral surface thereof. The piston 20 includes a piston pin hole 24, and a piston pin (not shown) inserted through the piston pin hole 24 is connected to a connecting rod (not shown).

Figure 6:
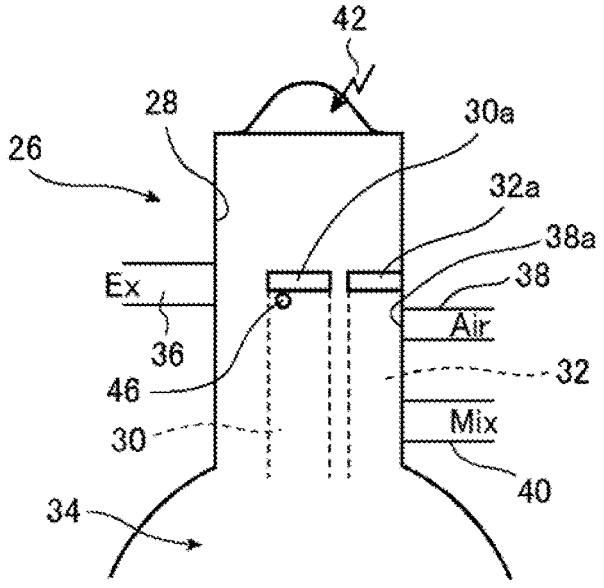
FIG. 6 is a diagram for describing a configuration of a cylinder included in an air leading-type stratified scavenging two-stroke internal-combustion engine according to the embodiment of the present invention.

The piston 20 is fitted in a cylinder 26, which is illustrated in FIG. 6, so as to be vertically and reciprocatably movable. The cylinder 26 includes first and second scavenging channels 30 and 32 in each of the left and the right sides in plan view, and the first and second scavenging channels 30 and 32 communicate with a crankcase 34. In the cylinder wall 28, first and second scavenging ports 30*a* and 32*a* open. The first scavenging ports 30*a* communicate with the respective first scavenging channels 30. The second scavenging ports 32*a* communicate with the respective second scavenging channels 32. In other words, the engine according the embodiment is a four-flow scavenging engine.

In the figure, reference numeral 36 denotes an exhaust channel. Also, reference numeral 38 denotes an air channel, and reference numeral 38*a* denotes an air port. Also, reference numeral 40 denotes an air-fuel mixture channel. Air is supplied to the air channel 38. Air-fuel mixture produced by a carburetor (not shown) is supplied to the air-fuel mixture channel 40, and the air-fuel mixture is supplied to the crankcase 34. Reference numeral 42 denotes a spark plug.

Also referring to FIG. 6, in the cylinder wall 28, gas venting ports 46 are formed as additional ports. The gas venting ports 46 communicate with the crankcase 34 via the respective first scavenging channels 30.

Figure 7:
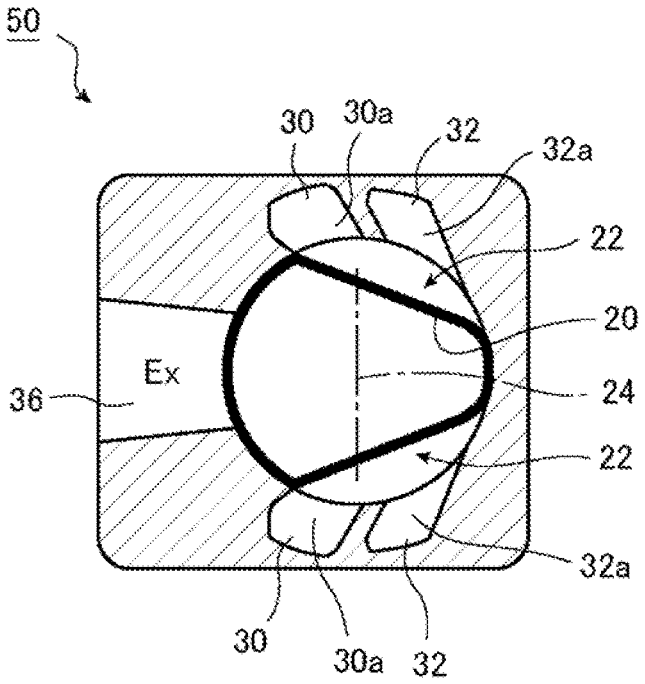
FIG. 7 is a horizontal cross-sectional view of the air leading-type stratified scavenging two-stroke internal-combustion engine according to the embodiment of the present invention, cut along a level of a height of an exhaust channel thereof.

FIG. 7 is a horizontal cross-sectional view of an air leading-type stratified scavenging two-stroke internal-combustion engine 50 according to the embodiment of the present invention. Referring to FIG. 7, the first scavenging ports 30*a* and the second scavenging ports 32*a* positioned in each of the left and the right sides are oriented in a direction opposite to the exhaust channel 36. In other words, the two-stroke engine 50 according to the embodiment is a loop scavenging engine. Here, FIG. 7 illustrates a state in which the piston grooves 22 are in communication with the respective first and second scavenging ports 30*a* and 32*a*. In this state, air is supplied to the first and second scavenging channels 30 and 32 through the piston grooves 22.

Figure 8:
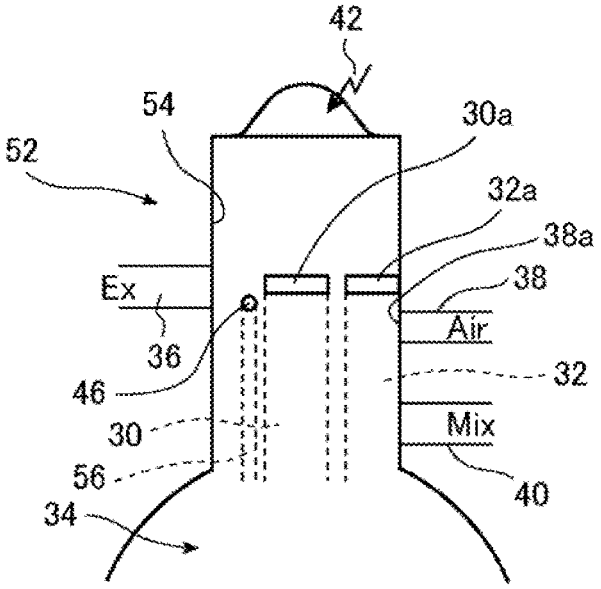
FIG. 8 is a diagram for describing a configuration of a cylinder included in an air leading-type stratified scavenging two-stroke internal-combustion engine according to an alteration of the embodiment of the present invention.

FIG. 8 illustrates a cylinder 52, which is an alteration of the cylinder 26 illustrated in FIG. 6. The cylinder 52 also includes first and second scavenging channels 30 and 32, and first and second scavenging ports 30*a* and 32*a* open in a cylinder wall 54. Also, in the cylinder wall 54, gas venting ports 46 open. The gas venting ports 46 communicate with a crankcase 34 through respective gas venting channels 56 that are independent from the first and second scavenging channels 30 and 32.

Piston grooves 22 extend in a circumferential direction of the piston 20. The gas venting ports 46 are disposed at respective positions adjacent to the respective first scavenging ports 30*a* positioned on the exhaust port side.

Figure 9:
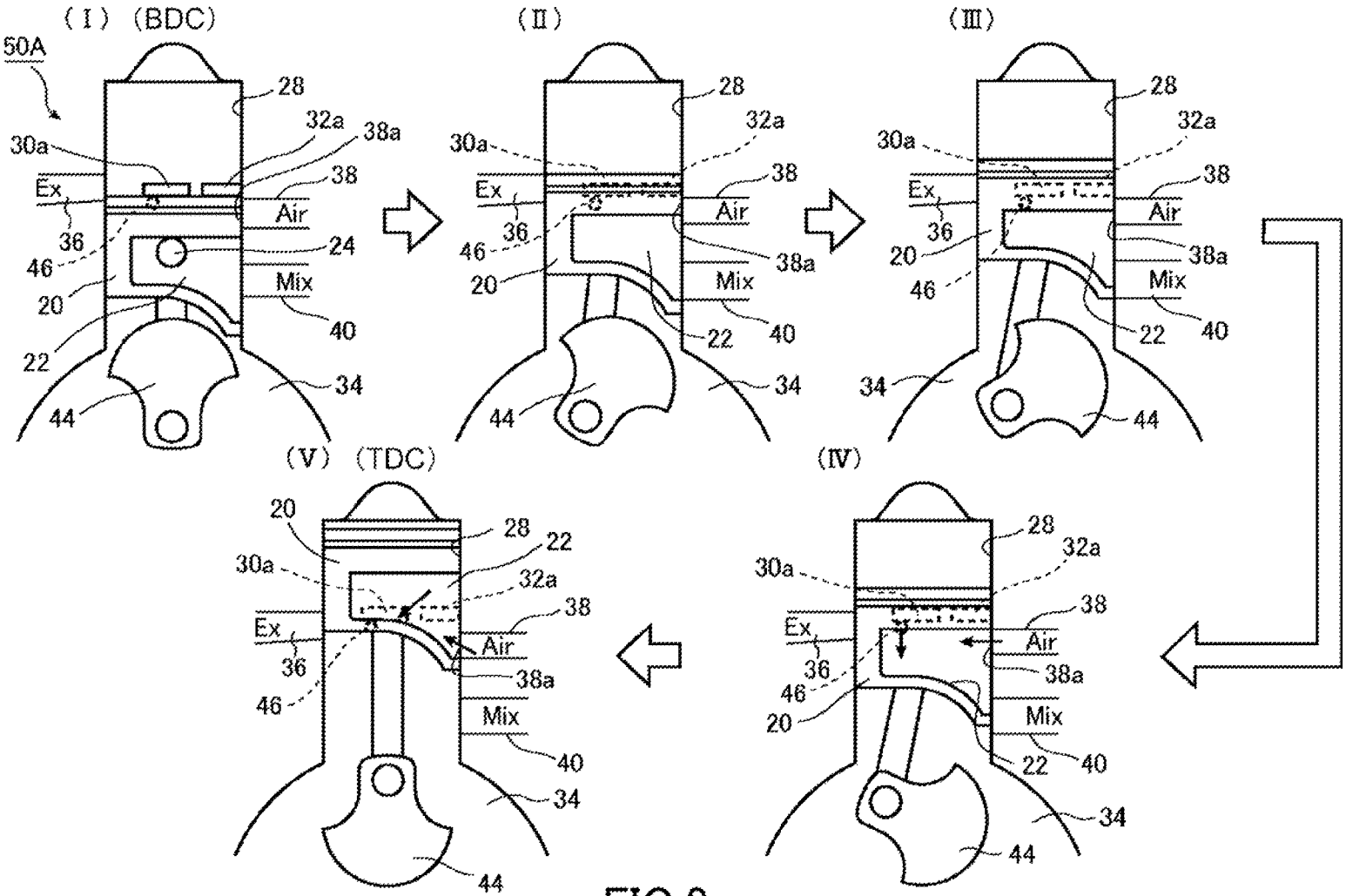
FIG. 9 is a diagram for describing states in the course of piston upward movement toward the top dead center in a two-stroke engine according to the embodiment of the present invention including a piston with a piston groove having a relatively-large vertical width: (I) illustrates a state in which the piston is positioned at the bottom dead center; (II) illustrates a state in which the piston moves up from the bottom dead center; (III) illustrates a state in which the piston further moves up and piston grooves are thereby brought into communication with an air port; (IV) illustrates a state in which the piston further moves up and the piston grooves are thereby brought into communication with a gas venting port; and (V) illustrates a state in which the piston is positioned at the top dead center.
Figure 10:
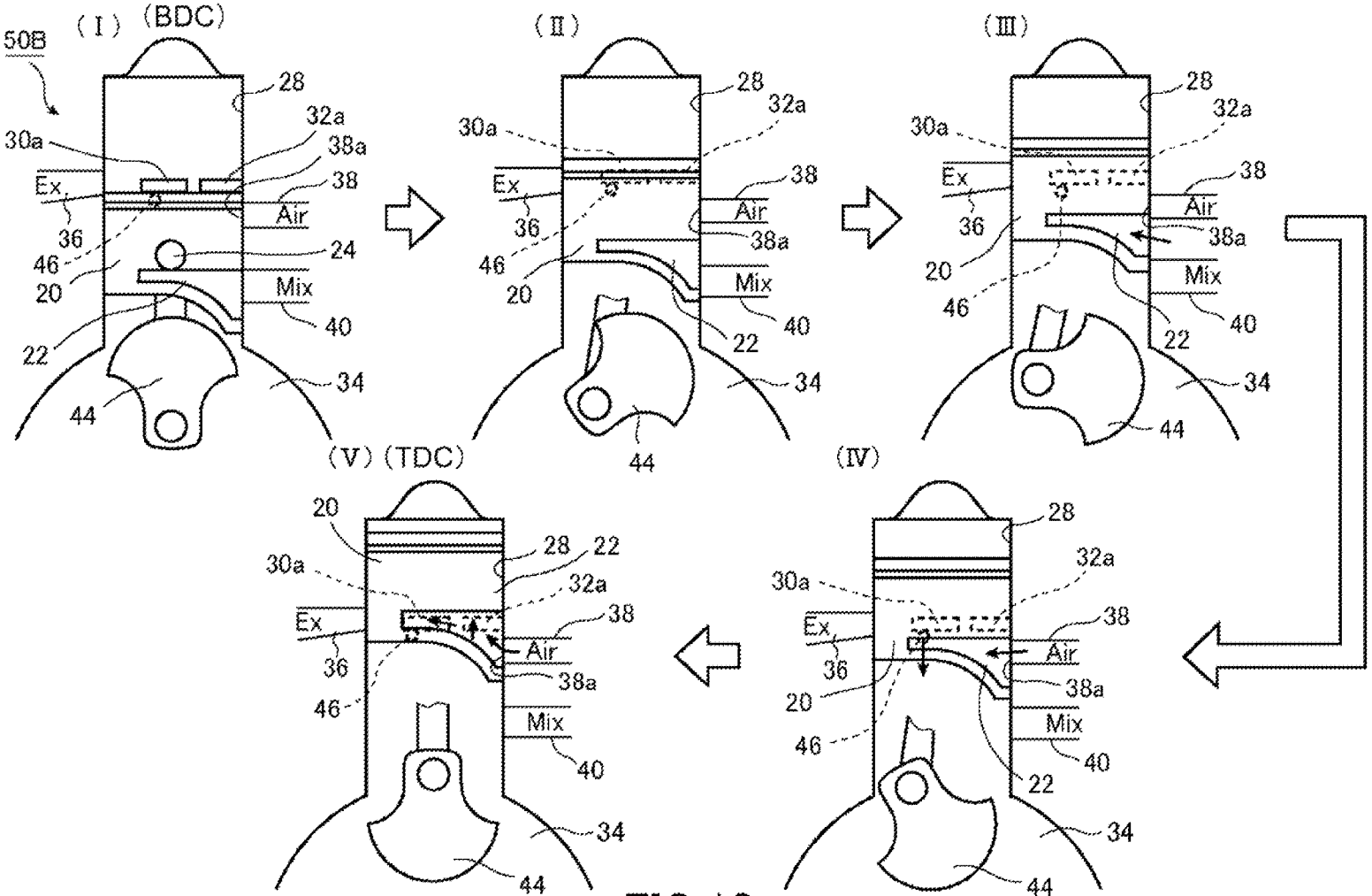
FIG. 10 is a diagram for describing states in the course of piston upward movement toward the top dead center in a two-stroke engine according to the embodiment of the present invention including a piston with a piston groove having a relatively-small vertical width: (I) illustrates a state when a piston is positioned at a bottom dead; (II) illustrates a state in which the piston moves up from the bottom dead center toward the top dead center; (III) illustrates a state immediately after the piston further moves up and a piston groove comes into communication with an air port; (IV) illustrates a state in which the piston further moves up and the piston groove comes into communication with a gas venting port; and (V) illustrates a state in which the piston is positioned at the top dead center.

FIGS. 9 and 10 each indicate a specific example in which in the course of the piston moving up, air is supplied to the first and second scavenging channels 30 and 32 through the piston grooves 22 (In FIGS. 9 and 10, only the first and second scavenging ports 30*a* and 32*a* are illustrated). An engine 50A, which is illustrated in FIG. 9, has a configuration in which the piston grooves 22 are enlarged upward in order to increase respective volumes thereof. In an engine 50B, which is illustrated in FIG. 10, positions where the piston grooves 22 are formed are arranged below the piston pin hole 24 (FIG. 5). A vertical width of the piston grooves 22 is smaller than that of the piston grooves 22 illustrated in FIG. 9.

The engine 50A in FIG. 9, which includes piston grooves 22 each having a relatively-large vertical width, will be described. (I) of FIG. 9 illustrates the piston 20 positioned at the bottom dead center. Upon the piston 20 moving up toward the top dead center from the bottom dead center ((II) of FIG. 9), a pressure in the crankcase 34 becomes negative. Even if the piston 20 further moves up and the piston grooves 22 are thereby brought into communication with the air port 38*a*, gas inside the piston grooves 22 does not flow until the piston grooves 22 come into communication with the gas venting ports 46 ((III) of FIG. 9).

Upon the piston 20 further moving up and the piston grooves 22 that are in communication with the air port 38*a* being thereby brought into communication with the gas venting ports 46, the gas in the piston grooves 22 is drawn into the crankcase 34 via the gas venting ports 46, and following this, air is drawn from the air port 38*a* to the piston grooves 22 ((IV) of FIG. 9). In other words, a gas flow is generated inside each of the piston grooves 22.

Then, upon the piston 20 further moving up and reaching the top dead center, the first and second scavenging ports 30*a* and 32*a* come into communication with the piston grooves 22 while the gas venting ports 46 are closed by the piston 20 ((V) of FIG. 9). As an alteration, when the piston 20 is positioned at the top dead center, the gas venting ports 46 may open to the crankcase 34.

In the state in (IV) of FIG. 9, upon a gas flow being generated inside each of the piston grooves 22, a state in which the first and second scavenging ports 30*a* and 32*a* communicate with the piston grooves 22 and air enters the first and second scavenging ports 30*a* and 32*a* is created immediately after the generation of the flow until the state in (V) of FIG. 9 (top dead center). Therefore, the certainty of drawing air from the air channel 38 into the piston grooves 22 through the air port 38*a* and charging the air into the first and second scavenging channels 30 and 32 from the first and second scavenging ports 30*a* and 32*a* can be enhanced.

The engine 50B in FIG. 10, which includes piston grooves 22 each having a relatively-small vertical width, will be described. (I) of FIG. 10 illustrates the piston 20 positioned at the bottom dead center. Upon the piston 20 moving up toward the top dead center from the bottom dead center, a pressure in the crankcase 34 become negative, but gas inside the piston grooves 22 does not flow until the piston 20 further moves up and the piston grooves 22 are thereby brought into communication with the gas venting ports 46 ((II) and (III) of FIG. 10).

Upon the piston 20 further moving up toward the top dead center and the piston grooves 22 being thereby brought into communication with the gas venting ports 46, the negative pressure in the crankcase 34 affects the piston grooves 22, whereby the gas in the piston grooves 22 are sucked into the first scavenging channels 30 through the gas venting ports 46. Also, air in the air channel 38 is drawn into the piston grooves 22 through the air port 38*a*. In other words, simultaneously with the piston grooves 22 coming into communication with the gas venting ports 46, a gas flow is generated in each of the piston grooves 22.

Upon the piston 20 further moving up and reaching the top dead center, the first and second scavenging ports 30*a* and 32*a* come into communication with the piston grooves 22 while the gas venting ports 46 are closed by the piston 20 ((V) of FIG. 10). In the state in (V) of FIG. 10, upon a gas flow being generated in each of the piston grooves 22, a state in which the first and second scavenging ports 30*a* and 32*a* communicate with the piston grooves 22 and air enters the first and second scavenging ports 30*a* and 32*a* is created immediately after the generation of the air flow until the state in (V) of FIG. 10. Therefore, the certainty of drawing air into the piston grooves 22 from the air channel 38 through the air port 38*a* and charging the air into the first and second scavenging channels 30 and 32 from the first and second scavenging ports 30*a* and 32*a* can be enhanced.

Figure 1:
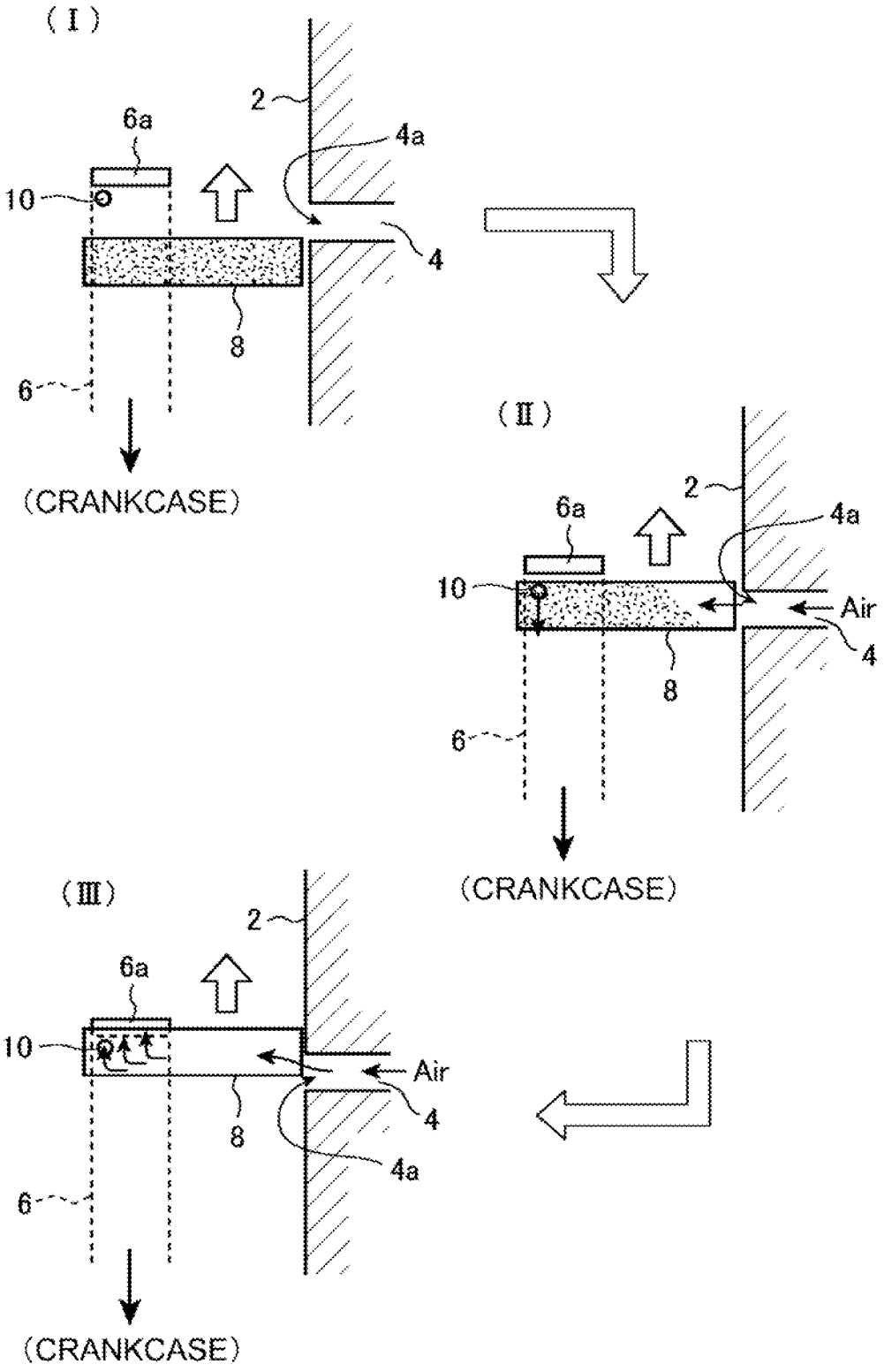
FIG. 1 is a diagram for describing a configuration and operation of the present invention: (I) illustrates a state immediately before a piston moves up from the bottom dead center toward the top dead center and a piston groove is thereby brought into communication with an air port; (II) illustrates a state in which the piston further move up toward the top dead center and the piston groove that is in communication with the air port is thereby brought into communication with a gas venting port; and (III) illustrates a state in which the piston further move up and the piston groove is thereby brought into communication with a scavenging port.
Figure 2:
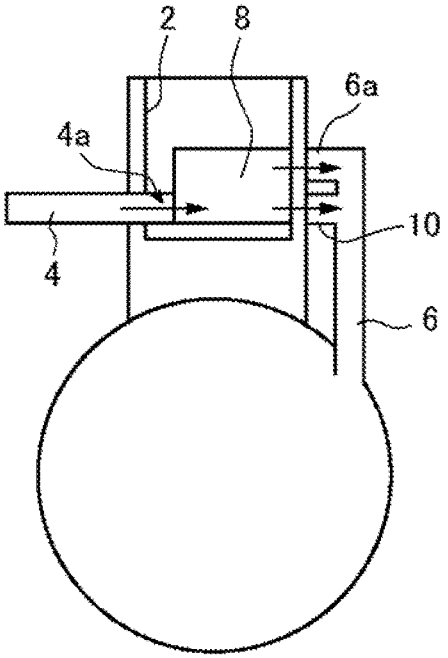
FIG. 2 is a diagram illustrating an example piston groove included in the present invention in order to describe setting of a height dimension of a piston groove.
Figure 3:
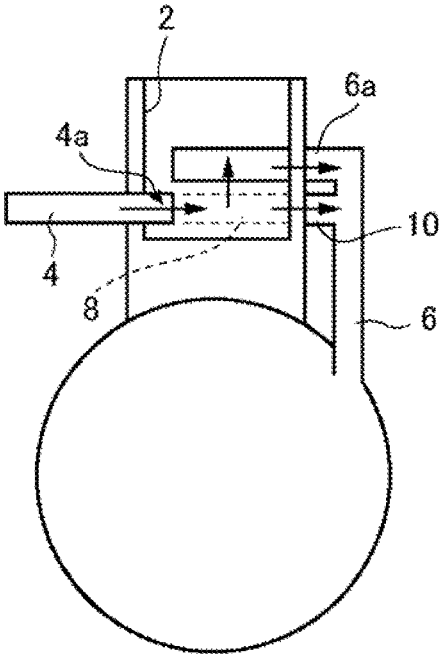
FIG. 3 is a diagram illustrating another example piston groove included in the present invention in order to describe setting of a height dimension of a piston groove.
Figure 4:
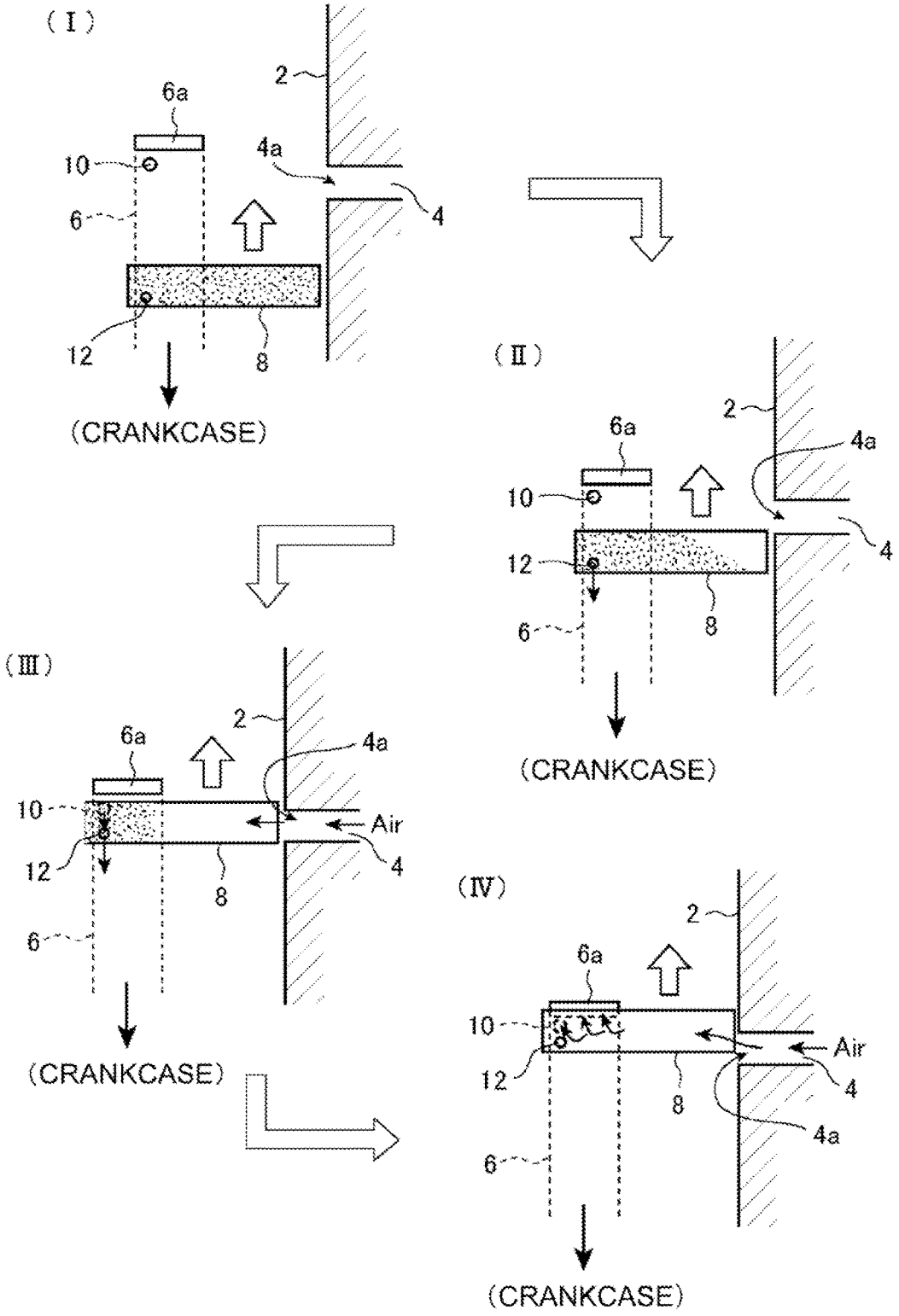
FIG. 4 is a diagram for describing another configuration and operation included in the present invention: (I) illustrates a state in which a piston starts moving up from the bottom dead center toward the top dead center; (II) illustrates a state immediately before a piston groove comes into communication with an air port; (III) illustrates a state in which the piston further moves up toward the top dead center and the piston groove that is in communication with the air port is thereby brought into communication with a gas venting port; and (IV) illustrates a state in which the piston further moves up and the piston groove is thereby brought into communication with a scavenging port.
Figure 11:
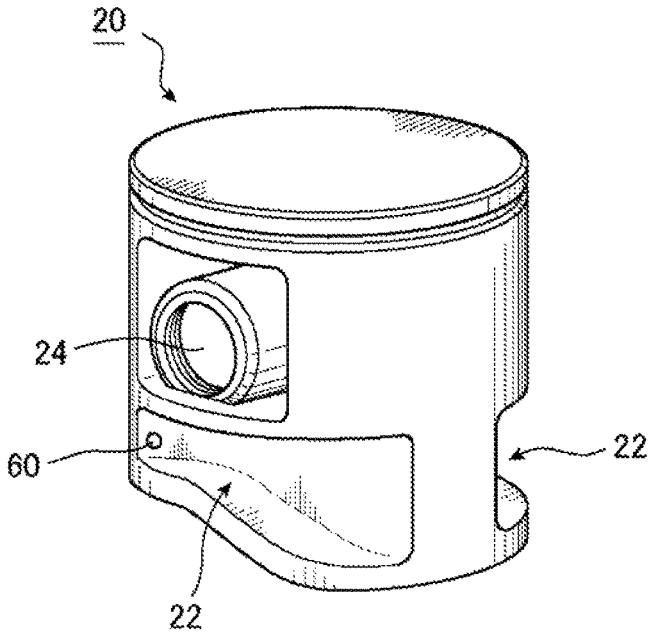
FIG. 11 is a perspective view of a piston included in an air leading-type stratified scavenging two-stroke internal-combustion engine according to an alteration of the embodiment.
Figure 12:
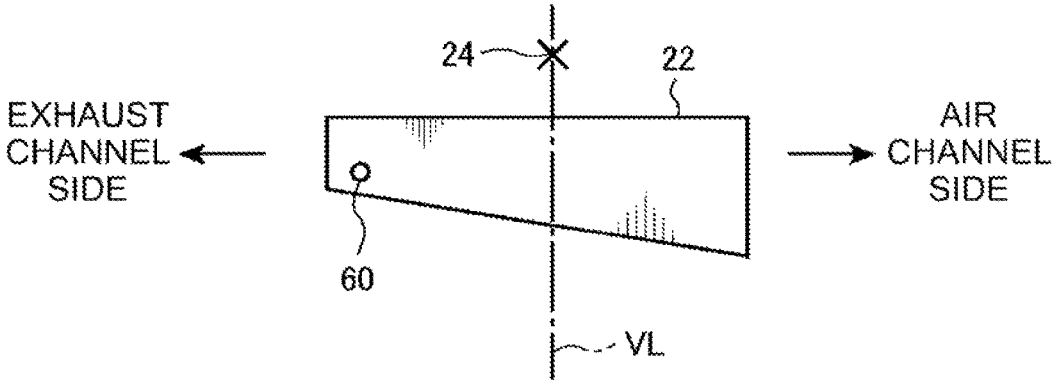
FIG. 12 is a front view of a piston groove in the piston illustrated in FIG. 11.
Figure 13:
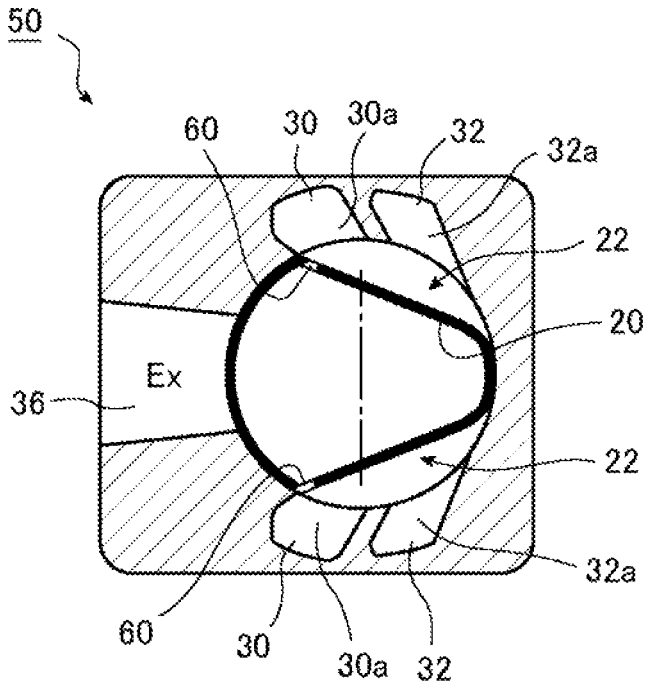
FIG. 13 is a horizontal cross-sectional view of the engine including the piston illustrated in FIG. 11 cut along a level of a height of an exhaust channel thereof.
Figure 14:
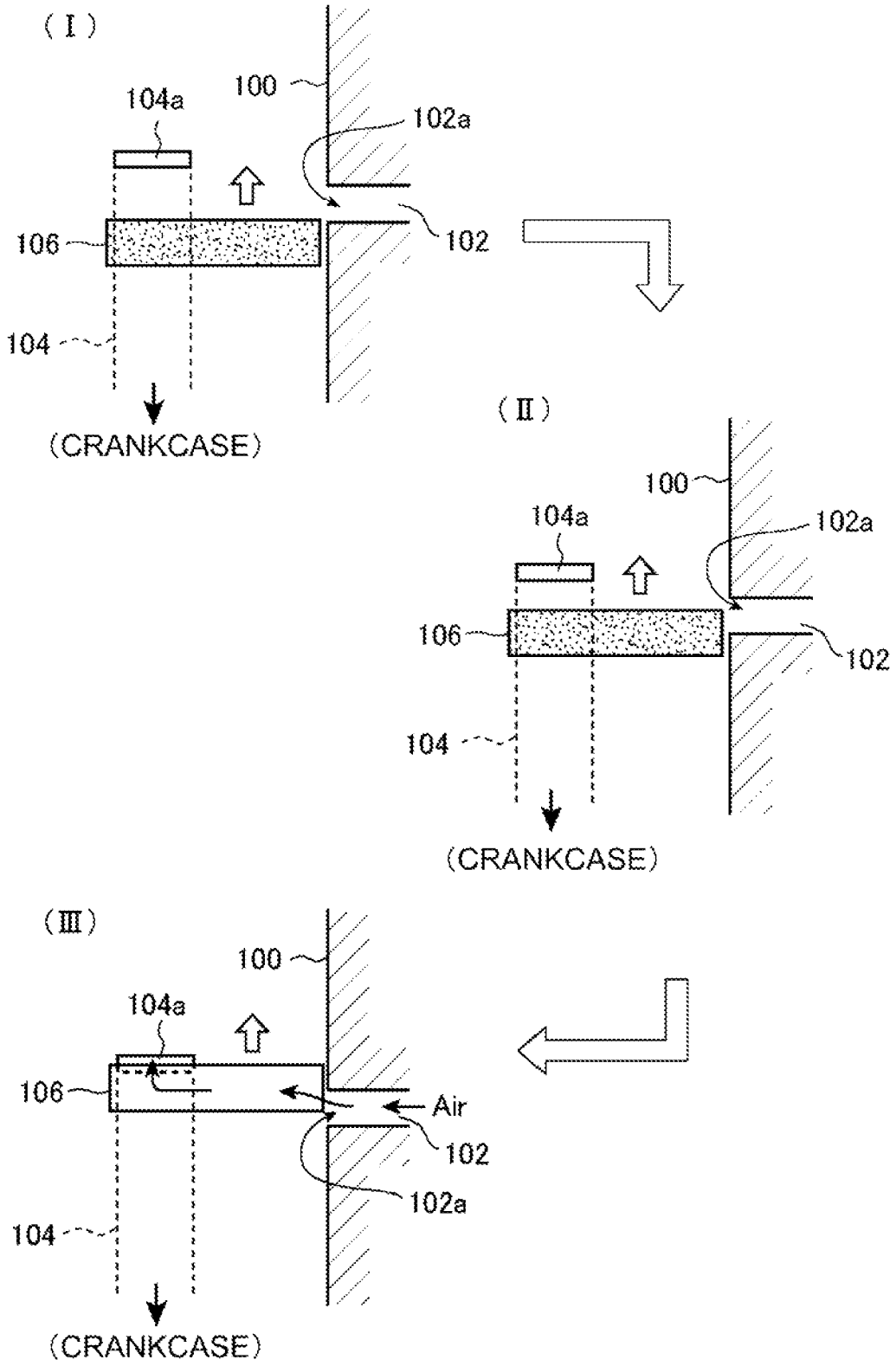
FIG. 14 is a diagram for describing states in the course of piston upward movement toward the top dead center in a conventional two-stroke engine: (I) indicates a state immediately before a piston groove comes into communication with an air port; (II) indicates a state in which a piston moves up toward the top dead center and the piston groove is thereby brought into communication with the air port; and (III) indicates a state in which the piston further moves up toward the top dead and the piston groove that is in communication with the air port is thereby brought into communication with a scavenging port.

FIGS. 11 to 13 are diagrams relating to an alteration of the engine described above. The alteration illustrated in FIGS. 11 to 13 is related to FIG. 4 described above. In a piston 20 included in the engine illustrated in FIGS. 11 to 13, a pressure transmission through hole 60 is formed in each of piston grooves 22, and the pressure transmission through holes 60 consistently communicate with a crankcase 34. The pressure transmission through holes 60 illustrated in FIGS. 11 to 13 correspond to the pressure transmission through holes 12 described with reference to FIG. 4.

Each pressure transmission through hole 60 may be arranged at an arbitrary position in the relevant piston groove 22. A test shows that it is effective to arrange the pressure transmission through holes 60 on the downstream side of the piston grooves 22. With reference to FIG. 12, the alternate long and short dash line is a vertical line VL running across a piston pin hole 24. Arrangement of the pressure transmission through holes 60 on the downstream side relative to the vertical line VL running across the piston pin hole 24 (the left side in FIG. 12) is effective for generating a preferable gas flow inside the piston grooves 22. In other words, it is preferable that the pressure transmission through holes 60 be disposed at respective positions adjacent to the respective first scavenging ports 30*a* (FIG. 6) positioned on the exhaust port side.

The pressure transmission through holes 60 may have a diameter of 0.1 to 3.0 mm, preferably a diameter of 0.5 to 2.5 mm, most preferably a diameter of 1.0 to 2.0 mm. In the embodiment, the pressure transmission through holes 60 are arranged in respective downstream ends in a gas flow direction of the respective piston grooves 22, that is, left ends (ends on the exhaust port side) in FIG. 12, and positioned on the lower side (crankcase side) of the respective piston grooves 22 in front view of the piston grooves 22.

An engine according to the embodiment enables enhancement of the certainty of charging air to the scavenging channels. This means that the enhancement contributes to optimization of a timing for bringing the piston grooves and the scavenging ports into communication with each other and a timing for bringing the piston grooves and the air port into communication with each other. Consequently, an air leading-type stratified scavenging two-stroke internal-combustion engine with an output enhanced while exhaust gas emission characteristics are improved can be provided.

Although the embodiment has been described in terms of an engine with two scavenging ports 30*a* and 32*a* on each side and the two scavenging ports 30*a* and the two scavenging ports 32*a* on the opposite sides are symmetrically arranged, respectively, as a typical example, it should be understood that the present invention is not limited to this example. The present invention includes, for example, the following alterations:

(1) Engine including one scavenging port on each side;

(2) Engine with one or more scavenging ports on the respective sides arranged asymmetrically; and (3) Engine with a plurality of scavenging ports on each side, the scavenging ports being connected to, for example, one scavenging channel extending in a Y shape while a plurality of scavenging ports 30*a* and 32*a* on each side, the scavenging ports 30*a* and 32*a* being connected to independent scavenging channels 30 and 32 in the embodiment, are provided.

The present invention is applicable to an air leading-type stratified scavenging two-stroke internal-combustion engine. The present invention is favorable for use in a single-cylinder air-cooled engine to be mounted on a portable work machine such as a brush cutter or a chain saw.

20 piston
22 piston groove
24 piston pin hole
VL vertical line running across piston pin hole
26 cylinder
28 cylinder wall
30 first scavenging channel
30*a* first scavenging port
32 second scavenging channel
32*a* second scavenging port
34 crankcase
36 exhaust channel
38 air channel
38*a* air port
46 gas venting port
12, 60 pressure transmission through hole

What is claimed is:

1. An air leading-type stratified scavenging two-stroke internal-combustion engine comprising:

an air port that opens in a cylinder wall and is opened/closed by a piston;

a scavenging channel including a scavenging port that opens in the cylinder wall and is opened/closed by the piston, the scavenging channel communicating with a crankcase to induce an air-fuel mixture in the crankcase to flow directly into a combustion chamber in a scavenging stroke of the engine;

a piston groove formed in a peripheral surface of the piston, the piston groove enabling the air port and the scavenging port to communicate with each other to charge a lead air to the scavenging channel before the scavenging stroke; and a gas venting port that communicates with the crankcase through the scavenging channel, and opens in the cylinder wall independently from the scavenging port and is opened/closed by the piston to generate a gas flow in the piston groove prior to the piston groove coming into communication with the scavenging port, wherein the gas venting port is positioned on the crankcase side that is lower than the scavenging port in a cylinder axis direction, wherein in a course of the piston moving up toward the top dead center, before the piston groove that is in communication with the air port comes into communication with the scavenging port, the piston groove that is in communication with the air port comes into communication with the gas venting port, wherein in a course of the piston moving from the bottom dead center to the top dead center, the piston groove is brought into communication with the gas venting port and then is brought into communication with the scavenging port, and wherein when the piston is at the top dead center, the piston groove is not in communication with the air port.

2. The air leading-type stratified scavenging two-stroke internal-combustion engine according to claim 1, wherein the gas venting port is disposed at a position that allows the gas venting port to communicate with an end portion of the piston groove, the end portion being on a side opposite to a side on which the air port is positioned.

3. The air leading-type stratified scavenging two-stroke internal-combustion engine according to claim 2, wherein a plurality of the scavenging ports are disposed on a side of the engine; and wherein at a position adjacent to a scavenging port that is furthest from the air port from among the plurality of scavenging ports, the gas venting port is disposed.

4. The air leading-type stratified scavenging two-stroke internal-combustion engine according to claim 3, wherein the piston groove includes a pressure transmission through hole that consistently communicates with the crankcase.

5. The air leading-type stratified scavenging two-stroke internal-combustion engine according to claim 2, wherein the piston groove includes a pressure transmission through hole that consistently communicates with the crankcase.

6. The air leading-type stratified scavenging two-stroke internal-combustion engine according to claim 1, wherein the piston groove has a height dimension, wherein the piston has a direction of movement with respect to the cylinder wall and the height dimension is determined in the direction of movement of the piston, that allows the piston groove to simultaneously communicate with the scavenging port and the gas venting port when the piston groove is in communication with the air port.

7. The air leading-type stratified scavenging two-stroke internal-combustion engine according to claim 1, wherein a plurality of the scavenging ports are disposed on a side of the engine; and wherein at a position adjacent to a scavenging port that is furthest from the air port from among the plurality of scavenging ports, the gas venting port is disposed.

8. The air leading-type stratified scavenging two-stroke internal-combustion engine according to claim 1, wherein the piston groove includes a pressure transmission through hole that consistently communicates with the crankcase.

* * * * *